US005579842A

United States Patent [19]

Riley

[11] Patent Number: 5,579,842

[45] Date of Patent: Dec. 3, 1996

[54] BOTTOMHOLE DATA ACQUISITION SYSTEM FOR FRACTURE/PACKING MECHANISMS

[75] Inventor: Bobby D. Riley, Spring, Tex.

[73] Assignees: Baker Hughes Integ.; Dataline Petroleum Services, Inc., both of Houston, Tex.

[21] Appl. No.: 406,020

[22] Filed: Mar. 17, 1995

[51] Int. Cl.[6] ..... E21B 47/06

[52] U.S. Cl. ..... 166/250.01; 166/66.6; 175/40

[58] Field of Search ..... 166/250.01, 65.1, 166/53, 66.6, 64; 175/40, 50

[56] References Cited

U.S. PATENT DOCUMENTS

| | | | |
|---|---|---|---|
| 4,660,638 | 4/1987 | Yates, Jr. | 166/250 |
| 4,806,928 | 2/1989 | Veneruso | 175/40 X |
| 5,099,236 | 3/1992 | Kyle et al. | 175/40 X |
| 5,107,939 | 4/1992 | Lenhart et al. | 175/40 X |
| 5,130,705 | 7/1992 | Allen et al. | 166/250 X |
| 5,204,673 | 4/1993 | Kyle et al. | 175/40 X |
| 5,278,550 | 1/1994 | Rhein-Knudsen et al. | 175/40 X |
| 5,294,923 | 3/1994 | Juengen et al. | 175/40 X |

*Primary Examiner*—Frank Tsay
*Attorney, Agent, or Firm*—Bush, Moseley, Riddle & Jackson

[57] ABSTRACT

A method and apparatus for acquisition of downhole well data such as bottomhole pressure, bottomhole temperature, etc. which is utilized in conjunction with other well equipment such as gravel packer tools especially for data acquisition at well depths that are ordinarily rendered inaccessible by tools and other equipment located within the well. An instrument housing is fixed to other well equipment and is provided with equalizing ports which are normally closed by a sealing collet element. As the instrument is run into the well and into the instrument housing its upper end establishes sealing with the instrument housing to isolate the data acquisition chamber thereof from the flow passage from the well servicing tool. As it is run into the housing, a collet actuator mechanism unseats the collet to equalize pressure internally of the instrument housing with the external fluid pressure environment. After the acquisition of well data has been concluded, as the instrument is withdrawn from the instrument housing the collet actuator stem will shift the collet from its unseated position back to its seated and sealed relation thereby preventing further communication of the external fluid environment with the internal chamber of the instrument housing.

17 Claims, 7 Drawing Sheets

BOTTOMHOLE DATA ACQUISITION SYSTEM FOR FRACTURE/PACKING MECHANISMS

FIELD OF THE INVENTION

This invention relates generally to well treatment systems or mechanisms, especially high rate water packing/fracture packing mechanisms for fracturing and propping subsurface production zones of interest. More particularly, the present invention is directed to a method and apparatus for acquisition of downhole well data such as bottomhole pressure, temperature, etc. at a depth within the well that is ordinarily rendered inaccessible by tools and other apparatus within the well. Especially in the case of gravel packing activities during and after injection of fluidized materials into the well through one or more crossover ports and acquisition in the downhole environment is achieved below the depth of the crossover ports and at a location that is not adversely influenced by pressure drop and fluid turbulence at the crossover ports.

BACKGROUND OF THE INVENTION

After wells have been completed to the depth of one or more subsurface production zones and the zones have been determined to contain producible quantities of petroleum products, completion of the wells is often accomplished by gravel packing or propping activities wherein a fluid containing a quantity of sand, gravel and other proppant materials is injected into the well at high pressure and high rates of injection with injection being accomplished in the downhole environment in the immediate region of the production formation. When fluidized proppant materials are injected into the well under high pressure, the subsurface formation can develop fractures that extend radially outwardly from the well bore. When these fractures occur proppant materials such as sand and gravel will be caused to flow into the voids developed by the fractures and will fill the void and provide a porous support for opposed surfaces of the fractures as well as defining efficient flow paths for conducting petroleum products to the well for production. The porous support of the proppant material will permit petroleum products to flow from the formation into the fracture and through the proppant materials to the well bore for production through production tubing that will be installed as the final step of the completion activities.

Bottomhole pressure measurement is a valuable asset when performing formation propping activities, also known as enhanced prepacked completions. The types of pre-treatment tests recommended for enhanced prepacked completions are defined as are the types of well-site specific analysis values that are derived from each test. Additionally, various bottomhole pressure measurement techniques have been used in the past but these techniques typically have the short coming of being unable to provide pressure measurement and other data acquisition at a well depth below the crossover ports of the injection apparatus. For the reason that the pressure below the crossover ports, during proppant injection, is often in the range of 200 to 300 psi less than the pressure at the crossover ports, pressure measurement at or above the crossover ports can have considerable error.

Most well completion and production organizations advocate pre-treatment tests prior to performing an enhanced prepack well completion. The pre-treatment tests determine well-site specific values to insure the most effective completion will be provided. Analysis of pre-treatment tests, and the subsequent completion, is based on bottomhole pressure (BHP) data. BHP data improve analysis accuracy by eliminating surface pressure data interpretation errors due to fluid frictional effects and changing hydrostatic head as slurry concentration changes during the job. Industry options for BHP measurement include: Direct; real-time and memory downhole quartz crystal gauge, and Indirect; static annulus and computer modeling. There are prerequisite considerations for each of these techniques.

Industry clearly acknowledges that the most accurate method of BHP measurement at the present time is accomplished through the use of downhole quartz crystal gauges. Gauge location within the completion string has recently been gaining attention because pump rates have increased from a range of about 2 to 5 barrels per minute (bpm) to pump rates of 10 bpm, and higher. Gauge locations include; above, or below the crossover tool (fixed and non-retrievable) and placement within the washpipe. There are BHP data accuracy advantages to locating the gauge bundle carrier below the crossover port. In cases where the pressure gauge bundle is intended to be wireline retrievable however there has heretofore been no mechanism available for selectively locating the gauge bundle carrier below the crossover port and then providing for its subsequent retrieval independently of the gravel packer tool.

Prior to performing any enhanced prepack completion a suite of pre-treatment tests are recommended. Generally, these tests are performed immediately after perforating the well casing by locating downhole gauges in the well in the region of the casing perforations. It is accepted that BHP measurement with downhole quartz crystal gauges will provide more accurate analysis values. Real-time access to gauge measurements (electric line) is beneficial for applications where step-rate analysis indicates fluid leak-off will prevent formation fracture at maximum equipment pump rates.

During enhanced prepacking pre-treatment tests, and the subsequent completion, real-time bottomhole pressure can be determined directly from a quartz crystal gauge, or directly from a static annulus, or computer modeling. However, there are limitations for each of these techniques. During proppant stages, direct measurement techniques can employ gauges mounted to the exterior of the completion string to prevent the sensor and electric line from being damaged. If maximum casing pressures are of concern, the indirect static annulus method may not be applicable. If the formation will not support the hydrostatic head, neither the indirect static annulus or the computer model can be realisticly used.

Another method for obtaining recorded bottomhole pressure is via downhole memory gauges. When memory gauges are utilized, life requirements must considered as they are battery operated and have a maximum memory size. Memory gauges can be preprogrammed with a start data collection time and frequency of data collection. A minimum of two memory gauges are recommended for shallow depth wells and three gauges for deeper wells. It is recommended to stagger start times and frequency times. Five second sampling time is considered maximum for dynamic well conditions.

Memory gauges are termed non-real time as recorded data its accessible only when the gauges are retrieved at the surface. Generally, bottomhole data from memory gauges are not available for analysis until post-job. If real-time bottomhole gauges are not available, or static string measurement is not available, memory gauges are required as a minimum to support alternative bottomhole pressure recording measurements. The same mounting considerations apply here as with real-time gauges previously discussed.

In the past, a real-time quartz crystal gauge assembly has been mounted in a gauge carrier above the packer/crossover tool assembly. When a gauge carrier is used in this manner, the gauge or gauges are physically mounted externally of the pump-in tubing string and above the depth of the packer and thus can only sense bottomhole pressure in the annulus between the tubing string and casing at a depth above the packer. In this case, to provide real-time BHP data capabilities, an electric line is run to transmit data to the surface read out equipment from the pressure gauges. A pressure data acquisition system of this nature is incapable of measuring bottomhole pressure at a depth below the depth of the packer/crossover tool assembly.

In other cases a memory quartz crystal gauge assembly can be mounted in a gauge carrier and assembled to the tubing string above the packer. This pressure gauge assembly will be battery powered and will acquire downhole pressure data in accordance with a timed data acquisition sequence. Obviously, since the pressure gauge is secured to the tubing above the packer it is only capable of pressure detection in the annulus above the depth of the packer. Bottomhole data acquisition has not been previously available at a depth below the packer/crossover assembly through use of pressure gauge equipment of this nature. Additionally, the data from the pressure gauge assembly can be acquired for analysis only after the injection string has been recovered from the hole.

Another method that has been used for acquisition of BHP data is to provide for measurement with a static fluid analysis. In this case a gravel pack packer/crossover assembly is provided having a pressure gauge mounted for detection of bottomhole pressure at the bypass courts of the crossover tool. Bottomhole pressure measurement with this type of equipment can only accurately record bottomhole pressure when pumping activity is static. When high fluid rate pumping activity is in progress there will exist a significant pressure drop across the bypass ports so that pressure measurement during pumping activity will often exhibit significant error. Due to industry demands of increased completion pump rates, 10 bpm and higher gauge location within the completion string is considered of significant importance. At higher pump rates, dramatic turbulence is generated at the crossover port where the fluid being pumped down the string exits to the annulus between the tubing and casing below the depth of the packer and enters the perforated zone. The turbulent fluid activity generates additional frictional effects. If the gauge bundle carrier is located in the completion string, above the packer, the actual BHP of the perforated zone may be disguised. This disguise may result in inaccurate BHP analysis, specifically the tip screen-out associated with enhanced prepacking. Locating the downhole gauges below the crossover port is more critical with high leak-off carrier fluids. High fluid leak-off rates are generally associated with. HRWP, in which more than one tip screen-out may occur.

Although gauge location will affect the pre-treatment test data analysis previously discussed, it becomes more prominent when gravel laden fluid, or slurry, is pumped. Based on data presented to the industry, it is becoming increasing clear that for improved BHP data monitoring, and subsequent analysis gauges should be located below the crossover port when performing one of the enhanced prepacking techniques. This assumes no changes occur to the crossover port design to minimize frictional effects.

Placement of downhole gauges below the crossover port may consider two different arrangements. The first arrangement may consider the bundle carrier positioned between the crossover port and the top of the screen. The second arrangement may consider the gauge bundle carrier positioned in the washpipe. In most cases, positioning the bundle carrier in the washpipe places the gauges within the perforated interval. However, limitations may exist for washpipe positioning, such as washpipe diameter. Here again, in the event it is desired for the gauges to be retrievable without necessitating retrieval of the tubing string, no known procedure has been previously available for accomplishing both location of data gauges below the depth of the packer and crossover tool and also provide for retrievability of the gauge bundle carrier independently of the tubing string. It is considered quite desirable to provide a downhole well data acquisition system having the advantages of retrievability and also having the advantages of locating data gathering instruments such as pressure gauges within the tubing and at a desired depth below the packer and crossover assembly.

SUMMARY OF THE INVENTION

It is a principal feature of the present invention to provide a novel method for acquiring downhole data in wells, such as data reflecting fluid pressure, temperature, etc. during gravel packing and propping activities wherein the data is acquired at a well depth below the depth of the packer and crossover assembly of the gravel packing well completion system.

It is another feature of the present invention to provide a novel method for acquisition of downhole data below the depth of the packer and crossover assembly of a well completion tool which comprises opening a valve in the gravel packing tool, running a data acquisition instrument through the valve to a suitable depth below the packer and sealing the valve with respect to the packer and crossover assembly and reversing this procedure for independently retrievable recovery of the data acquisition instrument from the well.

It is also a feature of the present invention to provide novel apparatus for acquisition of downhole data below the depth of the packer and crossover assembly of a well completion tool during gravel packing and propping activities.

It is another feature of the present invention to provide novel apparatus for detecting bottom hole pressure and other well data at a depth below the packer/crossover mechanism of a gravel packer tool and to locate the pressure sensing instrument in isolated manner with respect to fluid turbulence and fluid pressure drop that typically exists at or near the bypass ports of the crossover tool.

It is an even further feature of the present invention to provide novel apparatus for detecting bottom hole pressure below the well depth of a crossover mechanism and providing for selective running and retrieval of the apparatus without necessitating removal of the gravel packing well completion system from the well.

Briefly, the various objects and features of-the present invention are realized by running a gravel packing tool within a well, wherein the tool is provided with an instrument housing which is supported by the bypass or crossover sub of the gravel packing tool immediately beneath the crossover ports thereof. A retrievable data acquisition instrument, such as a bottom hole pressure gauge, is selectively located in latched assembly within the instrument housing and acquires downhole well data in the electronic data storage system thereof for subsequent processing by computer equipment following its retrieval. Because of the importance of ensuring that the only openings that are present in the packer/crossover assembly are the bypass ports, it is necessary to ensure that both when the data acquisition instrument is installed and when it is removed the instrument housing will be sealed so that the rate of fluid injection through the crossover ports is not diminished in any manner. It is also necessary that the instrument housing be provided with a pressure equalizing port or ports to admit fluid pressure from the annulus and that these equalizing ports be provided with high pressure sealing capability. According to the present invention these features are effectively achieved by providing a sleeve type collet having spaced eternal seals for efficient sealing with the interior wall surface of the instrument both above and below the pressure equalizing ports. The collet is unseated from its sealing position within the instrument housing by a collet actuator during downward movement of the actuator and then reseated by the collet actuator upon subsequent upward movement of the collet actuator. Prior to upward collet movement, after the collet has stopped its downward movement by contact with a stop shoulder, a shear pin securing a collet actuator sleeve in place on a collet actuating stem is sheared to permit further downward movement of the collet actuating stem past the lower flexible end of the collet. When the collet actuating stem is subsequently moved upwardly, an actuating head defining the lower end of the collet actuating stem will engage the collet and move it upwardly to its sealing position. Further upward movement of the collet actuating stem will then withdraw the collet actuating stem from the collet. The collet actuating stem, together with its actuating sleeve, will be in assembly with the data acquisition instrument and with wireline running and retrieval apparatus and thus is easily retrieved when desired. After its retrieval from the well the apparatus is reset for subsequent collet actuation simply by replacement of the sheared retainer pin to again secure the collet actuation sleeve in fixed relation on the collet actuating stem.

BRIEF DESCRIPTION OF THE DRAWINGS

The various objects and advantages of this invention will become apparent to those skilled in the art upon an understanding of the following detailed description of the invention, read in light of the accompanying drawings which are made a part of this specification and in which.

DETAILED DESCRIPTION OF PREFERRED EMBODIMENT

As will be readily apparent to those skilled in the art, the present invention may be produced in other specific forms without departing from its spirit scope and essential characteristics. The present embodiment is therefore to be considered as illustrative and not restrictive, the scope of this invention being defined by the claims rather than the foregoing description, and all changes which come within the meaning and embraced therein.

Figure 1A:
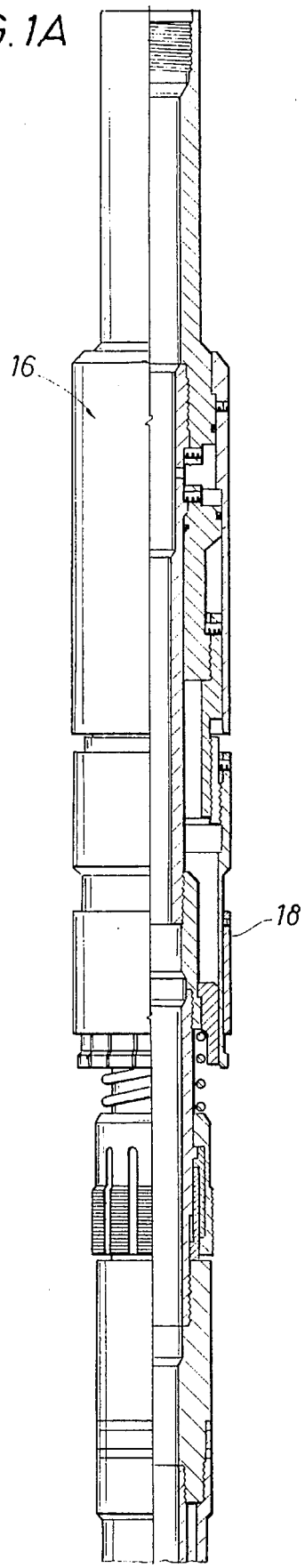
FIG. 1A is a partial sectional view of the upper portion of a gravel packer tool which is latched within a wash pipe to permit injection of fluid material into a well through a packer and crossover assembly thereof and which is adapted for receiving the downhole data acquisition system of the present invention in retrievable relation therein.
Figure 1B:
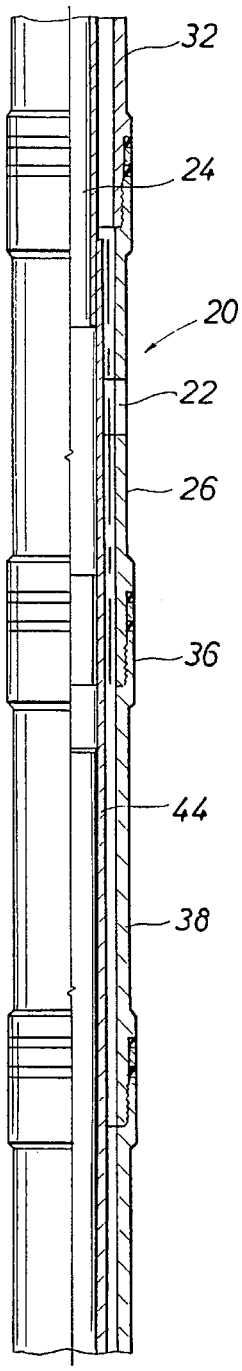
FIG. 1B is a partial sectional view of an intermediate section of the gravel packer tool of FIG. 1A and showing the upper end of the data acquisition instrument housing of the present invention in supported assembly therein.
Figure 1C:
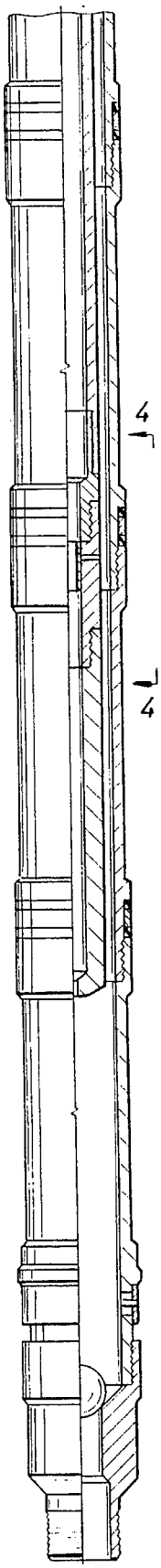
FIG. 1C is a partial sectional view of the lower extremity of the gravel packer tool of FIGS. 1A and 1B and showing the relation of the data acquisition instrument housing of this invention to the gravel packer tool.
Figure 1D:
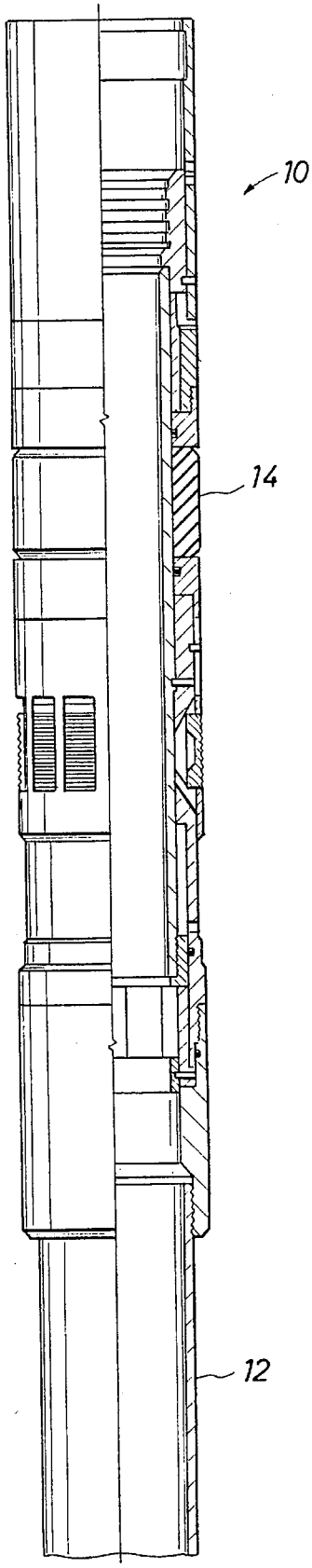
FIG. 1D is a partial sectional view of the upper extremity of a gravel packer tool for sealing engagement with the internal wall surface of the well casing and which is adapted for landing and latching the gravel packer tool assembly of FIG. 1A therein.

Referring now to the drawings first to FIGS. 1A, 1B and 1C, 1D, a gravel packing tool is shown generally at 10 and is provided with a washpipe tool housing 12 which is adapted for setting at a desired depth within a well casing by means of a packer assembly 14 shown in FIG. 1D. At its upper end the packer assembly of the washpipe provides for seating and latching of a gravel packer injection tool shown generally at 16 in FIG. 1A. The gravel packer injection tool 16 is provided with a latch mechanism 18 as shown in FIG. 1A enabling it to be seated and latched within the landing and packer assembly comprising the upper end of the apparatus shown in FIG. 1D. The gravel packer tool 16 includes an intermediate portion shown generally at 20 in FIG. 1B which is identified herein as a crossover assembly defining one or more crossover ports 22 through which liquid proppant material is injected from the inner tubular passage 24 to the annulus between the gravel packer tool and the washpipe surrounding it. Intermediate the length of the washpipe there is provided perforations through which the liquid proppant material is injected into the well casing in the immediate region of the casing perforations. When injected at high pressure and velocity the proppant material will develop fractures into the formation and will cause the proppant material, typically a fairly viscous liquid containing sand and other particulate, so that the fractures become filled with a rather porous granular medium that prevents the fractures from closing and which also functions to define an efficient fluid flow path through which production fluids may flow from the production zone through the casing perforations and into the casing for production via a production tubing string. The crossover sub 20 is shown in greater detail in FIG. 5.

As mentioned above, when proppant fluid is injected from the flow passage 24 through the crossover ports a considerable pressure drop is developed across the crossover ports and significant fluid turbulence is also developed at the crossover ports. At the pressures and pumping rates being employed at the present time the pressure drop across the crossover ports can be in the range of 200 to 300 psi or so. Additionally, at the crossover ports the high velocity fluid flow that exists creates considerable turbulence. Fluid pressure sensors that are located in the immediate region of the crossover ports can have considerable inaccuracy because of the pressure drop and the turbulence that exists. As also mentioned above it is considered highly desirable to acquire bottomhole pressure data at a location that is below the depth of the crossover ports so that the depth gauge will accurately sense the pressure of fluid injection into the formation and will also be free of turbulence that might cause pressure gauge inaccuracy. As shown in FIG. 1B and in greater detail in FIG. 5 the crossover assembly 20 incorporates a tubular crossover sub 26 having a plurality, typically three, crossover ports 22 defined therein. The crossover sub also defines a return passage 28 through which fluid is enabled to flow as it is displaced by the injected proppant fluid. Further, at the completion of proppant injection activity, proppant fluid will also be returning upwardly through the flow passage 28. The tubular sub 26, if desired may include a plurality of return passages such as that shown at 28.

Figure 4:
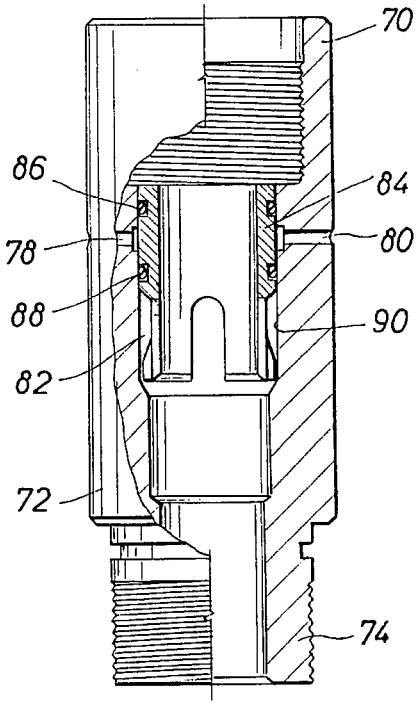
FIG. 4 is a partial sectional view of the collet and collet sub assembly of the data acquisition instrument housing of the present invention.
Figure 5:
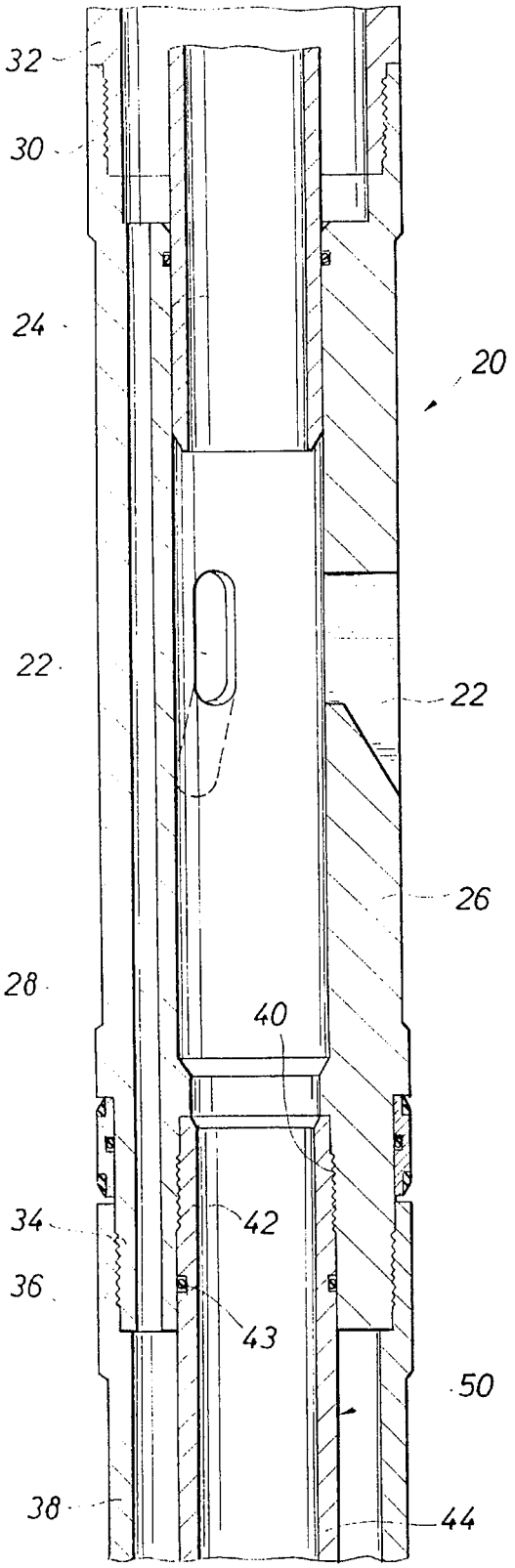
FIG. 5 is an enlarged partial sectional view of the crossover sub of the gravel packer tool of FIG. 1C and showing the internal collet thereof in it sealed position with respect to the pressure equalizing passages thereof.
Figure 6A:
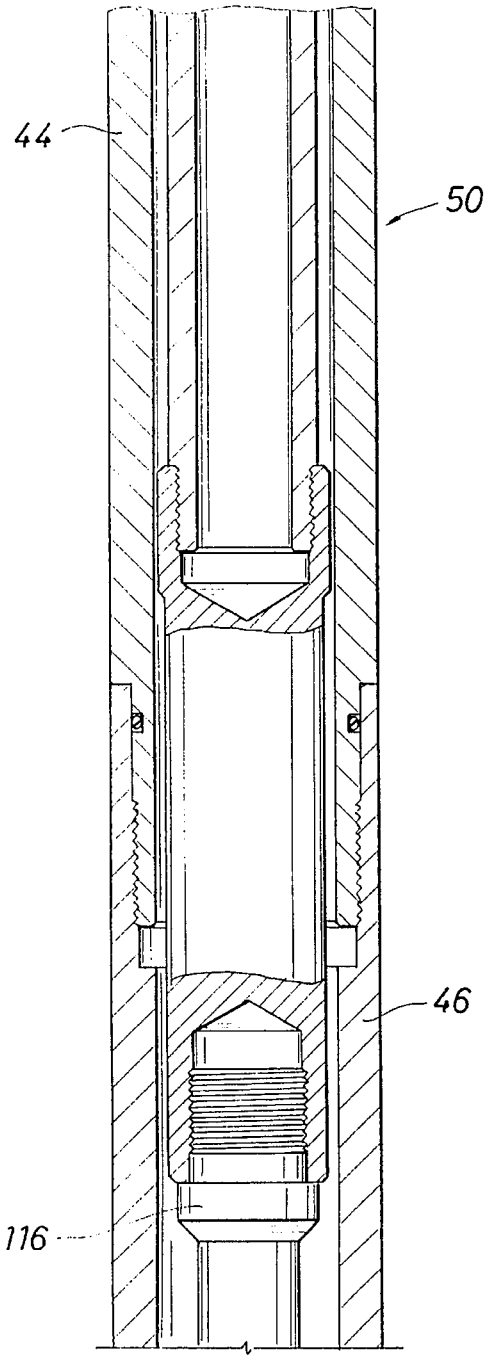
FIG. 6 is a partial sectional view of the data acquisition instrument of the present invention and showing the collet actuating mechanism being located above the seated and sealed collet as would occur when the collet actuating mechanism is being moved downwardly through the instrument housing just prior to collet actuation.
Figure 6B:
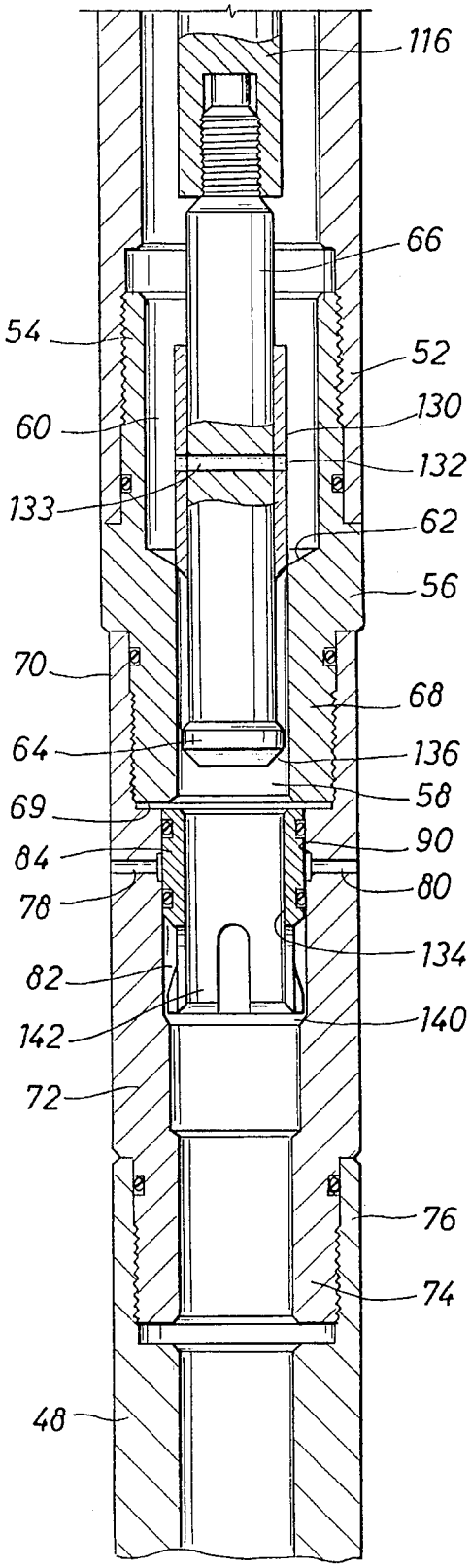

As shown in the detailed sectional view of FIG. 5 the tubular crossover sub 26 is provided with an internally threaded upper box connection 30 which threadedly receives a housing member 32 of the gravel packer tool of FIGS. 1A–1C. At its lower end the tubular crossover sub 26 is provided with an externally threaded pin section 34 which is in threaded engagement with the upper, internally threaded box connection 36 of another housing section 38. The lower end of the tubular crossover sub 26 is also provided with an internally threaded section 40 which is adapted to receive the upper externally threaded extremity 42 of the upper housing section 44 of the data acquisition instrument of the present invention in supported assembly therewith. The upper housing section 44 of the data acquisition instrument of this invention, shown generally at 50 in FIGS. 5 and 6 is sealed with respect to the tubular crossover sub 26 by means of a circular sealing element 43. The housing assembly of the data acquisition instrument 50 includes one or more intermediate housing sections such as shown at 46 and 48 in FIG. 6, these sections being interconnected by appropriate sealed threaded connections. The intermediate housing section 46 as shown in FIG. 6 is provided within internally threaded box connection 52 which receives the externally threaded pin connection 54 of an equalizing crossover sub 56. As further shown in FIG. 6 this crossover sub is provided with a lower internal passage section 58 which is of significantly less dimension as compared with the upper crossover sub passage 60 and at the juncture of passages 58 and 60 the crossover sub defines an internal tapered surface 62 which serves a guiding function for the head portion 64 of a collet actuator stem 66. The equalizing crossover sub 56 also defines an externally threaded pin connection 68 at its lower extremity which is adapted for sealed and threaded connection with the internally threaded box connection 70 that defines the upper end of a lower equalizing crossover sub 72 which is also shown in FIG. 4. The crossover sub 72 defines a lower externally threaded pin connection 74 which receives the upwardly directed internally threaded box connection 76 of the instrument housing section 48. The crossover sub 72 also defines a plurality of equalizing passages such as shown at 78 and 80 which intersect a central passage 82 within which is normally located a collet member 84. The collet 84 is provided with a pair spaced external seals 86 and 88 that establish sealing within internal cylindrical sealing surface 90 that is also intersected by the equalizing passages 78 and 80. Thus, in the collet position shown in FIG. 4 the pressure equalizing passages 78 and 80 will be sealed by the collet seals and will thus prevent fluid pressure interchange between the internal passage 82 and the environment externally of the instrument housing.

Figure 2:
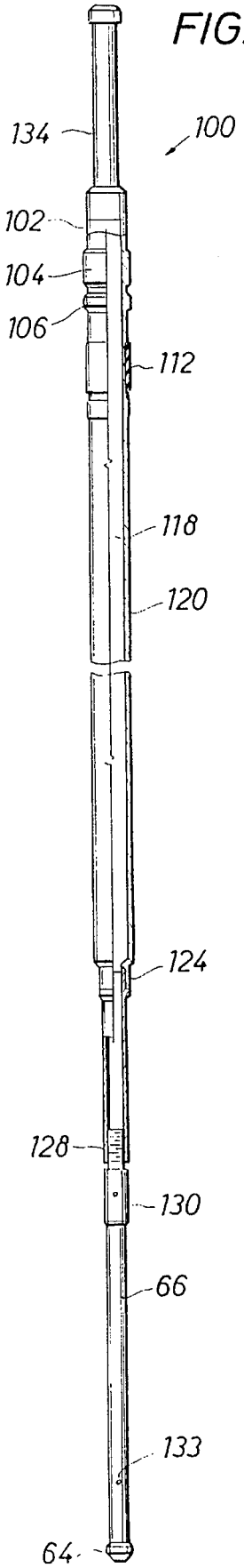
FIG. 2 is a partial sectional view of a data acquisition instrument and instrument running and retrieval mechanism for attachment to a wireline running tool and showing the instrument in the installed position thereof.
Figure 3:
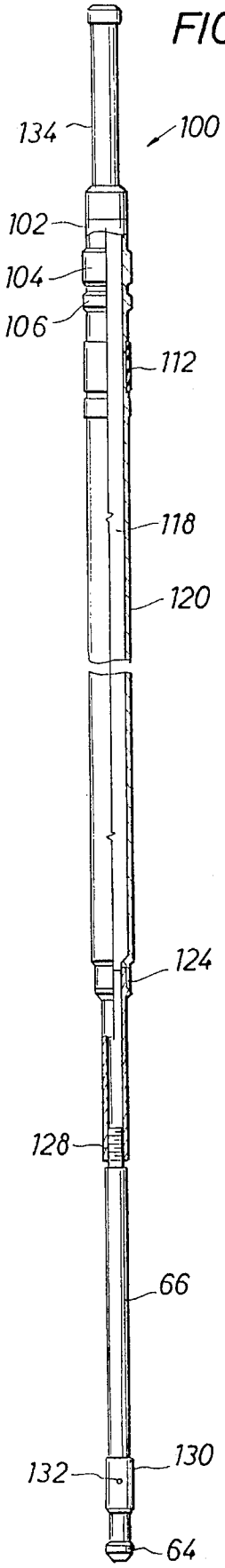
FIG. 3 is a partial sectional view of the data acquisition instrument and instrument running and retrieval mechanism of FIG. 2 and showing the instrument in the run in position thereof prior to further downward movement thereof to the installed position of FIG. 2.
Figure 5A:
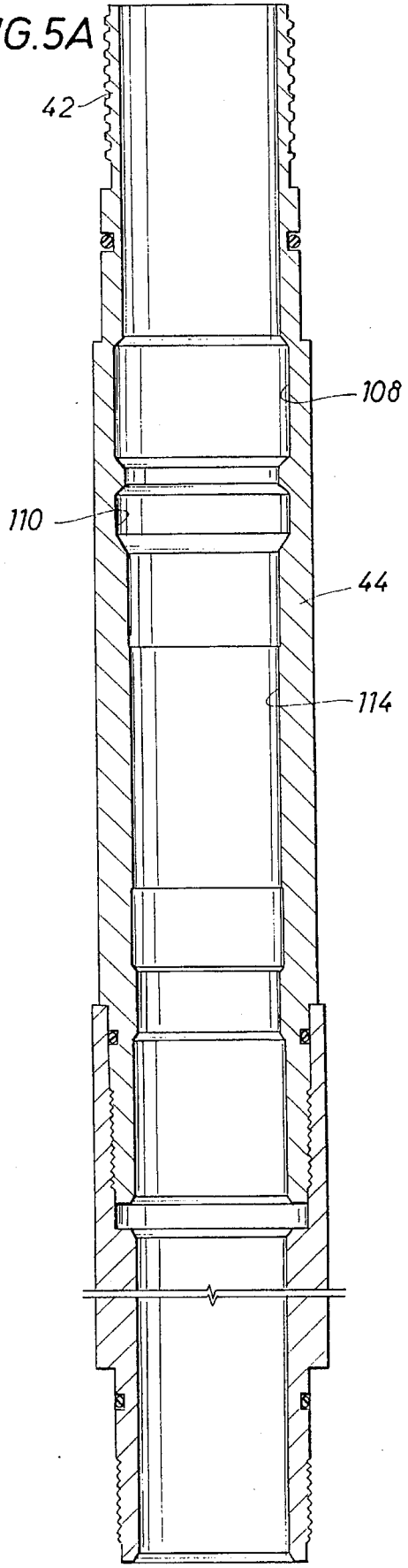
FIG. 5A is a sectional view of the upper housing sub of the downhole data acquisition instrument of the present invention and which is adapted for assembly to the crossover sub of the gravel packer tool as shown in FIG. 5.

As shown in particularly in FIGS. 2 and 3 a downhole data acquisition instrument shown generally at 100 is provided with a latch mechanism 102 having a latch 104 that enables the instrument to be landed and latched with respect to the internal landing and latching profiles 108 and 110 of the upper housing sub 44 which is shown in FIG. 5A. A packing 112 provided externally of the instrument assembly immediately below the latch mechanism is adapted for sealing engagement with an internal sealing surface 114 within the upper housing sub to insure that, with the instrument in latched position within the instrument housing, the flow passage 84 of the gravel packer tool will be isolated from the instrument housing.

The instrument 100 is provided with one or more data acquisition sections 116, such as electronic pressure gauges for example, and also typically include an electronics section 118 for data processing and storage. The electronics section is enclosed within an instrument housing 120 which is secured by a housing connector 122 to the latch and packing section of the instrument. The data acquisition section 116 is preferably secured by a threaded connection 124 to the lower end of the instrument housing.

As the instrument 100 is run into the instrument housing 50 by suitable wireline running equipment or by any other suitable means, for sensing well pressure below the crossover assembly of the gravel packer tool it will be necessary to unseat the collet element 84 by driving it downwardly sufficiently for clearance of the upper seal 86 passed the equalizing ports 78 and 80. To accomplish this feature the data acquisition instrument is provided with an elongate collet actuator stem 66, also shown in FIGS. 6–8. Which is connected to the data acquisition section 116 by means of a threaded connection 128. The collet actuator stem 66 is provided with an actuator head 64 as described above and is further provided a collet actuator sleeve 130 which is releasably secured to the actuator stem by means of a shear pin 132. At its upper end the data acquisition instrument is provided with a fishing neck 134 by which it may be installed and retrieved such as by means of conventional wireline running and retrieval tools. In the position shown in FIG. 3 the shear pin 132 is present within the shear pin opening 133 of the collet actuator stem and thus the collet actuator sleeve 130 is maintained in fixed but releasable relation with respect to the collet actuator stem.

From the standpoint of operation the collet actuator stem and its shear pin retained actuating sleeve 130 will appear essentially as shown in FIG. 6 as the data acquisition instrument is run into the well and into received relation with the instrument housing. The collet 84 under this circumstance will be in its upper most or closed position providing for sealing of the equalizing passages 78 and 80.

Figure 7A:
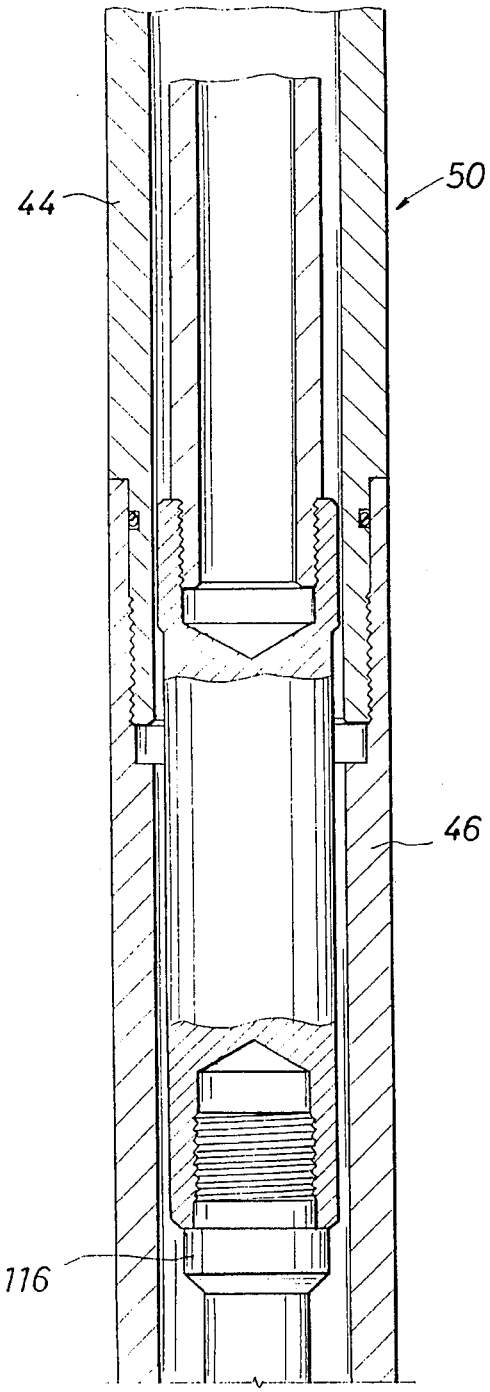
FIG. 7 is a partial sectional view similar to that of FIG. 6 and showing the collet actuating mechanism in actuating engagement with the seated and sealed collet.
Figure 7B:
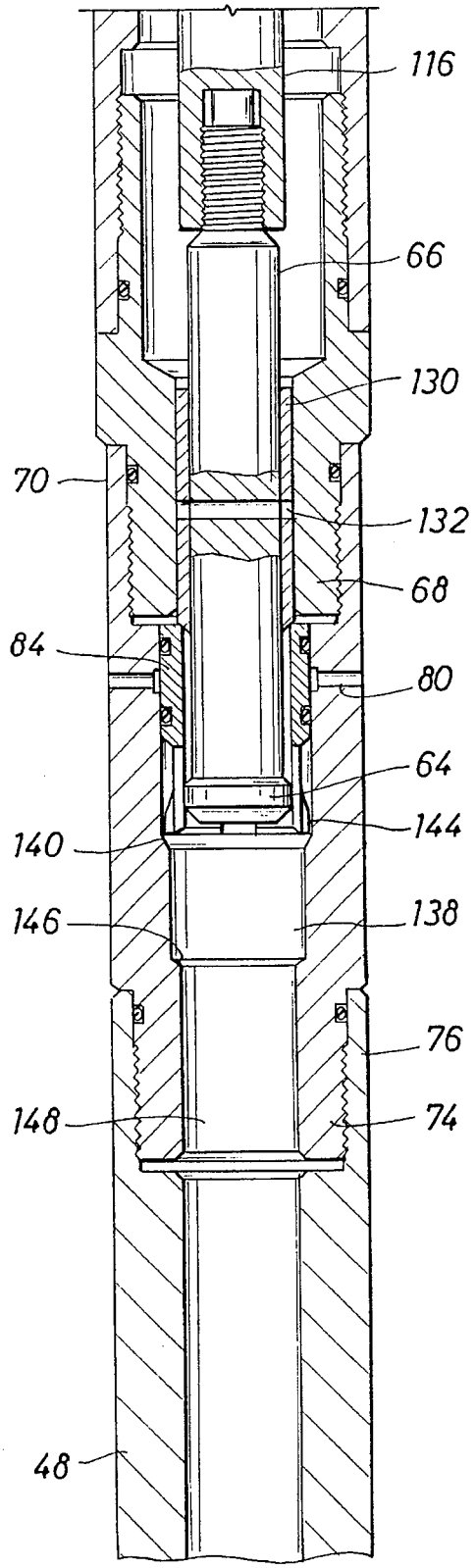
Figure 8A:
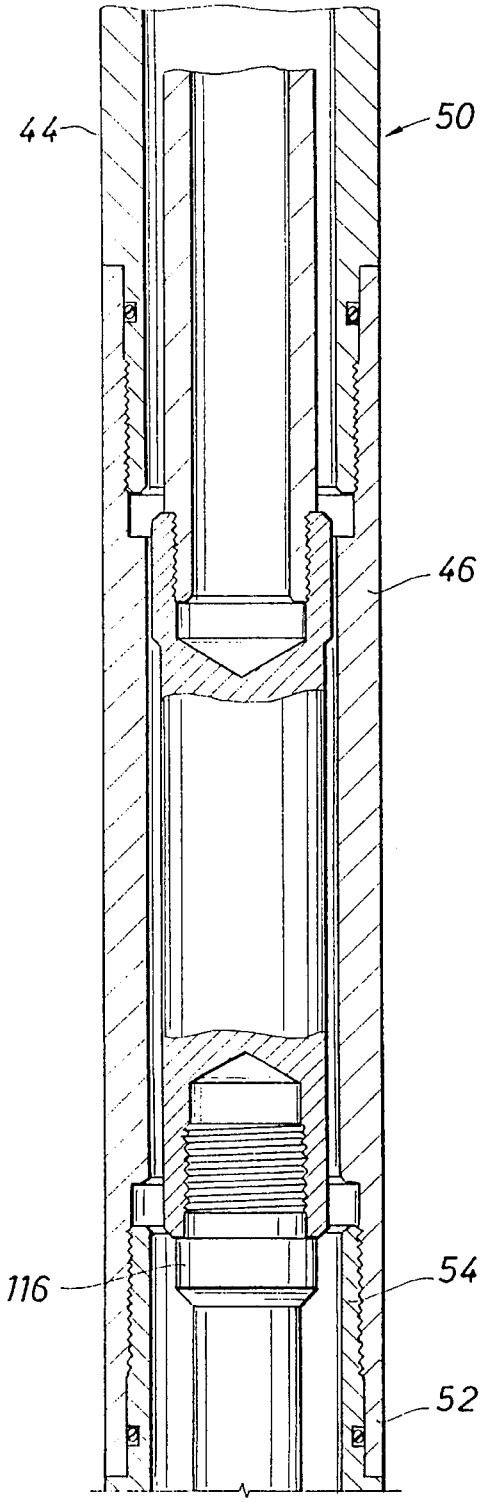
FIG. 8 is a partial sectional view similar to that of FIGS. 6 and 7 and showing the collet moved downwardly to its unseated position and the collet actuating stem moved downwardly past its pin shearing position and prepared for collet resealing upon subsequent upward movement.
Figure 8B:
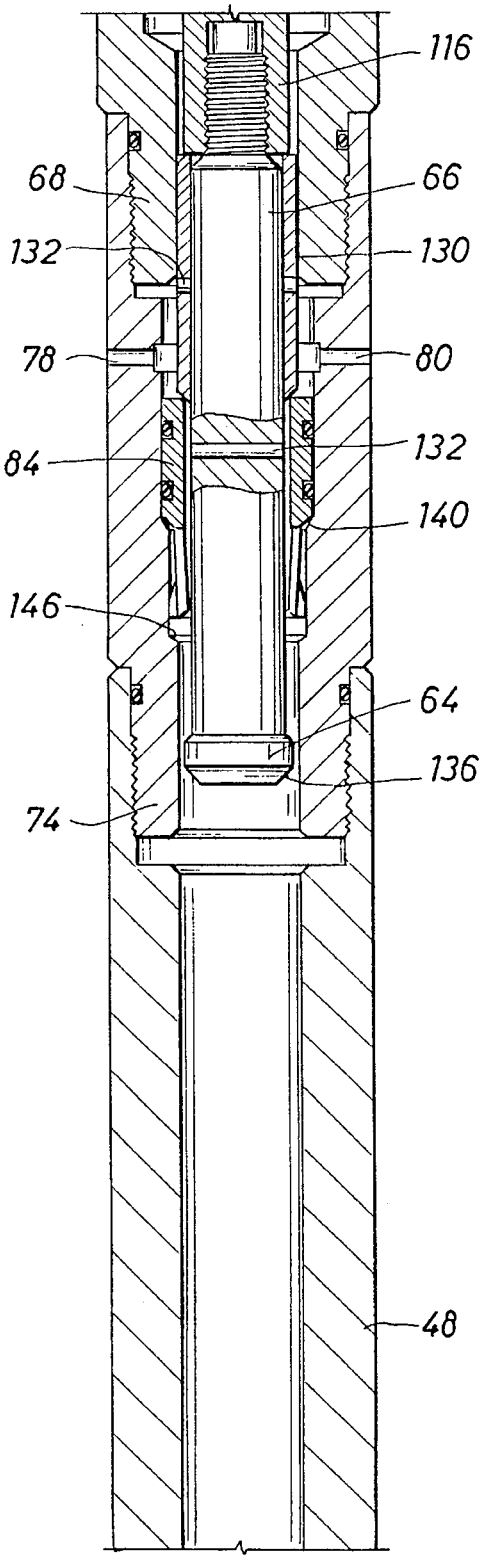

Upon further downward movement of the collet actuator stem 66, as shown in FIG. 7 the actuator head portion 64 of the collet actuator stem 66 will enter the internal bore 134 of the collet, being guided by the tapered lower end 136 of the actuator head 64. When downward movement of the collet actuator stem 66 has occurred to the extent shown in FIG. 7 the collet actuator sleeve 130 will be in actuating contact with the upper end of the collet. At this point the shear pin 132 will retain the actuator sleeve 130 in fixed relation relative to the collet actuator stem. As the collet actuator stem is moved further downwardly from the FIG. 7 position the collet actuator sleeve will drive the collet member downwardly into the lower extent of the collet receptacle 138. As the collet is moved passed the tapered internal shoulder surface 140 the collet fingers 142 will collapse by virtue of the camming activity that takes place as the external collet finger enlargements 144 are forced inwardly by the tapered cam shoulder 140. After the collet member 84 has moved downwardly sufficiently for its lower extremity to contact the internal tapered stop shoulder 146, whereupon the collet will be restrained from further downward movement. Upon downward movement of the collet actuator stem 66, after the collet has engaged the stop shoulder 146 the shear pin 132 will be sheared and the actuator sleeve 130 will be free for movement relative to the actuator stem. As the actuator stem moves downwardly to its full extent the actuator sleeve position will change essentially as shown at 130 in FIG. 2, this being the fully installed position of the data acquisition instrument.

After the collet has been stopped against the internal shoulder 146 and further downward movement of the collet actuator stem occurs, the actuator head 64 of the collet actuator stem will move further downwardly into the passage section 148 thereby clearing the flexible fingers 142 at the lower end of the collet. As long as data acquisition is intended the collet actuator stem 66 will remain in its fully down position and the collet 84 will remain unseated to permit external pressure to equalize within the instrument housing via the equalizing passages 78 and 80.

After data acquisition has been completed and is desired to retrieve the instrument 116 from the well it will be necessary to shift the collet from its unseated position upwardly to the seated position shown in FIG. 6. This is accomplished simply by moving the data acquisition 100 upwardly by means of an appropriate wireline tool. When the collet actuator stem 66 is moved upwardly, the upwardly facing tapered surfaces of the actuator head 64 will engage the lower end of the collet by virtue of the flexible collet fingers 142 being collapsed or forced radially inwardly. The collet will be shifted upwardly by the actuator head 64 until the upper end of the collet moves into stopping engagement with the downwardly facing shoulder 69 of the pin connection 68. After upward collet movement has occurred sufficiently for the flexible fingers 142 to clear the tapered internal shoulder 140 the flexible collet fingers 142 will spring back to their original positions thereby opening the passage 134 sufficiently that the actuator head 64 of the collet actuator stem can move through the collet passage for retrieval upwardly through the tool string along with the wireline tool and the other components of the data acquisition instrument. Thus, without removing the gravel packer mechanism from the well the data acquisition system of the present invention may be efficiently run into the well and utilized for detection of well parameters such as bottomhole pressure, bottomhole temperature, etc. The instrument of the present invention may also take the form of a well surveying or logging tool that may utilized for data acquisition simultaneously with the conduct of other well completion activities. Further, the downhole data acquisition instrument of the present invention may be efficiently utilized with well drilling and servicing equipment other than gravel packer tools. Thus, it is not intended to limit the spirit and scope of the present invention to the acquisition of downhole well data concurrently with the conduct of gravel packing and formation fracturing and propping operations.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A method for downhole data acquisition in wells during gravel packing and formation propping activities comprising:

(a) locating a a gravel packing and formation propping tool within a well said gravel packing and formation propping tool having at least one crossover port through which gravel packing and formation propping fluid flows from the tool, the tool having an instrument housing in assembly therewith, said instrument housing having an internal chamber and at least one data sensing port therein for communicating said internal chamber with the well fluid externally of the instrument housing below the crossover port and having a valve element disposed therein and being movable from a sealing position preventing fluid communication with said internal chamber through said data sensing port to an open position permitting fluid communication with said internal chamber through said data sensing port;

(b) positioning a downhole data acquisition instrument within said well servicing tool and in sealed relation with said instrument housing;

(c) during said positioning of said downhole data acquisition instrument within said instrument housing, moving said valve element from said open position thus communicating well fluid externally of said instrument housing with said internal chamber through said data sensing port;

(d) acquiring the downhole well data from the well fluid within said internal chamber;

(e) retrieving said data acquisition instrument from said instrument housing for conveyance to the surface; and (f) during said retrieving said data acquisition instrument moving said valve element from said open position to said sealing position thereof.

2. The method of claim 1, wherein said valve element is a collet valve element being linearly movable within said instrument housing and at the sealing position thereof having sealing engagement within said instrument housing on opposed sides or said port, said method further comprising:

(a) with a collet valve actuator on said data acquisition instrument during running of said data acquisition instrument into said instrument housing contacting said collet valve element and shifting said collet valve element downwardly from said sealed position to said open position; and (b) with a collet valve actuator head on said collet valve actuator, during retrieval of said data acquisition instrument, engaging said collet valve element and moving said collet valve element linearly upwardly from said position to said sealed position thereof.

3. The method of claim 2, wherein a valve actuating sleeve is disposed about said collet valve actuator and a shear pin securing said valve actuating sleeve in immovable and releasable relation with said collet valve actuator, said method further comprising:

(a) during said running of said data acquisition instrument into said instrument housing extending said collet valve actuator through said collet valve element and contacting the upper end of said collet valve element with said valve actuating sleeve and shifting said collet valve element from said sealed position to said open position;

(b) moving said collet valve actuator further downwardly and shearing said shear pin for releasing said valve actuating sleeve from said immovable relation with said collet valve actuator and moving said actuating head to a level below said collet valve element; and (c) moving said collet valve actuator upwardly and causing said valve actuator head to engage said collet valve element and move said collet valve element upwardly from said open position to said sealed position.

4. Apparatus for acquiring downhole well data, comprising:

(a) a well servicing tool adapted for positioning at a predetermined depth within a well;

(b) an instrument housing being in assembly with said well servicing tool and defining an internal chamber and further defining at least one port for communicating said internal chamber with the well fluid externally of said instrument housing;

(c) a valve element disposed within said instrument housing and being movable from a sealing position preventing fluid communication with said internal chamber through said port to an open position permitting fluid communication with said internal chamber through said port;

(d) a downhole data acquisition instrument adapted for running through said well servicing tool and into said internal chamber and adapted for sealed positioning thereof within said instrument housing; and (e) valve actuator means being carried by said downhole data acquisition instrument and upon running of said downhole data acquisition instrument into said internal chamber engaging said valve element and moving said valve element from said sealed position to said open position, said valve actuator means upon retrieval of said downhole data acquisition instrument from said instrument housing engaging said valve element and moving said valve element from said open position to said sealed position thereof.

5. The apparatus of claim 4, wherein said valve element comprises:

(a) a tubular collet valve element being movably positioned within said instrument housing and defining a plurality of collet fingers thereon; and (b) a pair of spaced sealing elements being located externally of said tubular collet valve element and establishing sealing engagement within said instrument housing on opposed sides of said port.

6. The apparatus of claim 4, wherein:

said instrument housing defines an internal collet receptacle and further defines a collet stop shoulder for limiting downward movement of said collet valve element.

7. The apparatus of claims 4, wherein said valve element is a collet valve element and said valve actuator means is a collet valve actuator, said apparatus further comprising:

(a) an elongate collet actuator stem projecting downwardly from said data acquisition instrument and adapted for passage through said collet valve element;

(b) an actuator sleeve being located about said elongate collet actuator stem and defining a collet actuating shoulder thereon disposed for actuating engagement with said collet valve element; and (c) release means securing and coiled actuator sleeve in selectively immovable and releasable relation with said elongate collet actuator stem and releasing said actuator sleeve from immovable relation with said elongate collet actuator stem upon downward movement of said elongate collet actuator stem after engagement of said collet valve element with said collet actuating shoulder.

8. The apparatus of claim 7, wherein said release means comprises:

(a) registering openings being defined in said elongate collet actuator stem and said actuator sleeve; and (b) a shear pin being located in said registering openings and securing said actuator sleeve in immovable relation with said elongate collet actuator stem, said shear pin being sheared upon movement of said elongate collet actuator stem relative to said actuator sleeve.

9. The apparatus of claim 4, wherein:

(a) said well servicing tool being a gravel packer tool adapted for positioning within a well casing and having a crossover sub having at least one crossover port through which fluid is directed from said gravel packer tool to the annulus surrounding said gravel packer tool;

(b) said instrument housing being disposed in supported relation within said gravel packer tool and being located below said crossover port; and (c) said port in said instrument housing being located below said crossover port.

10. The apparatus of claim 4, wherein:

(a) said well servicing tool being a gravel packer tool having at least one crossover port through which gravel packing and formation propping fluid flows from said gravel packer tool;

(b) said instrument housing having an upper extremity connected in supported relation within said gravel packer tool, said upper extremity defining an internal sealing surface located below said crossover port; and (c) said data acquisition instrument having an external packer thereon disposed for sealing engagement with said internal sealing surface.

11. The apparatus of claim 10, wherein:

(a) said instrument housing having a tubular pressure equalizing sub located below said internal sealing surface and defining said internal chamber and having at least one port for communicating said internal chamber with the well environment externally of said pressure equalizing sub, said internal chamber defining a collet valve seat within the upper end thereof and a collet valve receptacle within the lower end thereof, said collet valve receptacle defining a collet stop shoulder;

(b) said valve element being a tubular collet valve element being movably positioned within said internal chamber of said pressure equalizing sub and defining a plurality of collet fingers thereon; and (c) a pair of spaced sealing element being located externally of said tubular collet valve element and establishing sealing engagement within said pressure equalizing sub on opposed sides of said port.

12. Apparatus for acquiring downhole well data, comprising:

(a) a gravel packer tool adapted for positioning at a predetermined depth within a well casing;

an elongate instrument housing having the upper extremity thereof being connected in supported assembly within said gravel packer tool and defining an internal chamber and further defining at least one pressure equalizing port for communicating said internal chamber with the well fluid in the annulus between said instrument housing and said gravel packer tool;

(c) a collet valve element disposed within said instrument housing and being movable from a sealing position preventing fluid communication with said internal chamber through said port to an open position permitting fluid communication with said internal chamber through said pressure equalizing port;

(d) a downhole data acquisition instrument adapted for running through said gravel packer tool and into said internal chamber and adapted for sealed positioning thereof within said instrument housing; and (e) an elongate collet valve actuator stem extending downwardly from said downhole data acquisition instrument and upon running of said downhole data acquisition instrument into said internal chamber engaging said collet valve element and moving said collet valve element from said sealed position to said open position, said valve actuator stem upon retrieval of said downhole data acquisition instrument from said instrument housing engaging said collet valve element and moving said collet valve element from said open position to said sealed position thereof.

13. The apparatus of claim 12, wherein said collet valve element comprises:

(a) a tubular collet valve element being movably positioned within said instrument housing and defining a plurality of collet fingers thereon; and (b) a pair of spaced sealing elements being located externally of said tubular collet valve element and establishing sealing engagement within said instrument housing on opposed sides of said port.

14. The apparatus of claim 12, wherein:

(a) said instrument housing defines an internal collet receptacle and further defines a collet stop shoulder for limiting downward movement of said collet valve element;

(b) an elongate collet actuator stem projecting downwardly from said data acquisition instrument and adapted for passage through said collet valve element;

(c) an actuator sleeve being located about said elongate collet actuator stem and defining a collet actuating shoulder thereon disposed for actuating engagement with said collet valve element; and (d) release means securing said actuator sleeve in immovable and releasable relation with said elongate collet actuator stem and releasing said actuator sleeve from said immovable relation with said elongate collet actuator stem upon downward movement of said elongate collet actuator stem after engagement of said collet valve element with said collet stop shoulder.

15. The apparatus of claim 14, wherein said release means comprises:

(a) registering openings being defined in said elongate collet actuator stem and said actuator sleeve; and (b) a shear pin being located in said registering openings and securing said actuator sleeve in immovable relation with said elongate collet actuator stem, said shear pin being sheared upon movement of said elongate collet actuator stem relative to said actuator sleeve.

16. The apparatus of claim 12, wherein:

(a) said gravel packer tool having at least one crossover port through which gravel packing fluid flows from said gravel packer tool into the well casing;

(b) said instrument housing having an upper extremity connected in supported relation within said gravel packer tool, said upper extremity defining an internal sealing surface located below said crossover port; and (c) said data acquisition instrument having an external packer thereon disposed for sealing engagement with said internal sealing surface.

17. The apparatus of claim 16, wherein:

(a) said instrument housing having a tubular pressure equalizing sub located below said internal sealing surface and having at least one port for communicating said internal chamber with the well environment externally of said pressure equalizing sub, said internal chamber defining a collet valve seat within the upper end thereof and a collet valve receptacle within the lower end thereof, said collet valve receptacle defining a collet stop shoulder;

(b) said valve element being a tubular collet valve element being movably positioned within said internal chamber of said pressure equalizing sub and defining a plurality of collet fingers thereon; and (c) a pair of spaced sealing elements being located externally of said tubular collet valve element and establishing sealing engagement within said pressure equalizing sub on opposed sides of said port.

* * * * *